US007160137B1

(12) United States Patent
Yeh

(10) Patent No.: US 7,160,137 B1
(45) Date of Patent: Jan. 9, 2007

(54) PROTECTION STRUCTURE OF IEEE1394 CONNECTOR

(76) Inventor: Ming-Hsiang Yeh, 14F, No. 375, Nan-Gang District, Fu De Street, Taipei City (TW)

( * ) Notice: Subject to any disclaimer, the term of this patent is extended or adjusted under 35 U.S.C. 154(b) by 0 days.

(21) Appl. No.: 11/171,414

(22) Filed: Jul. 1, 2005

(51) Int. Cl.
*H01R 13/627* (2006.01)

(52) U.S. Cl. ..... 439/358

(58) Field of Classification Search ..... 439/352, 439/353, 358, 553, 607
See application file for complete search history.

(56) References Cited

U.S. PATENT DOCUMENTS 3,408,614 A * 10/1968 Kuwahata ..... 439/353
5,584,718 A * 12/1996 Sukegawa ..... 439/352
5,785,398 A * 7/1998 Park ..... 312/223.2
6,254,417 B1 * 7/2001 Pan ..... 439/350

* cited by examiner

*Primary Examiner*—Alexander Gilman
(74) *Attorney, Agent, or Firm*—Troxell Law Office, PLLC

(57) ABSTRACT

A protection structure of an IEEE1394 connector is disclosed. The protection structure for use in the IEEE1394 connector comprises a locking structure mounted on a first IEEE1394 connector. The locking structure is capable of hooking an opening formed on a second IEEE1394 connector that cooperates with the first IEEE1394 connector for enhancing the connection stability between the first and second connectors. In addition, a lock is mounted on the locking structure to provide the anti-theft IEEE1394 connector.

10 Claims, 8 Drawing Sheets

PROTECTION STRUCTURE OF IEEE1394 CONNECTOR

FIELD OF THE INVENTION

The present invention relates to an IEEE1394 connector having a protection structure for providing the function of protection to prevent theft, and this protection structure is suitable for various wires, connectors, conversion connectors, conversion wires, connectors of related apparatus, or the likes.

BACKGROUND OF THE INVENTION

After the adoption of the USB interface the IEEE1394 interface is gradually applied to the transmission in recent years. Because of equipping with the same Plug and Play function as the USB connector and the high transmission speed (about 400 Mbps), the IEEE1394 interface is widely applied to the transmission of the consumer electronic product such as entertainment product and computer peripheral, which requires high transmission speed.

In the practical application, the IEEE1394 interface is mainly applied to the location and the high speed equipment, for example, DVC, digital TV, high-resolution digital camera, games console, etc., which require transmitting image files at high speed so as to enhance efficiency.

Although the connected male and female connectors are capable of providing superior transmission effect, the transmission effect is affected if they are separated by careless pulling. In response to this, a hooking structure for use in an IEEE1394 connector is disclosed. The IEEE1394 connector comprises: a housing; a shaft fixed on the housing; an elastic plate having a second hook at a first end of the elastic plate; a force-reception part formed at a second end of the elastic plate; an elastic arm extended from the middle portion of the elastic plate to lean against the housing; and a circular pivotal connection part mounted on the center of the elastic plate. By using the circular pivotal connection part to receive the shaft, the elastic plate can be rotably connected to the shaft.

Although this connector can avoid the separation caused by careless pulling, another corresponding connector, which mounts on the electronic device for connection with the connector, still needs to be changed into the same kind of connector. If this corresponding connector does not provide the corresponding hooks, it is incapable of achieving the purpose of connection.

In view of the description mentioned above, the present inventor makes a diligent study to disclose and fabricate a protection structure for use in an IEEE1394 connector without changing the connector structure of the general electronic device, wherein the protection structure of the IEEE1394 connector is capable of enhancing the connection stability and preventing the theft.

SUMMARY OF THE INVENTION

It is a main object of the present invention to provide a protection structure for use in an IEEE1394 connector to enhance the connection stability effectively and protect the male and female connectors from being separated by careless pulling.

It is another object of the present invention to provide a protection structure for use in an IEEE1394 connector to protect the male and female connectors from being stolen by unauthorized person.

In order to achieve the aforementioned object, a locking structure is mounted on a first IEEE 1304 connector for hooking an opening formed on a second IEEE1394 connector that cooperates with the first IEEE1394 connector for enhancing the connection stability between the first and second connectors. In addition, a lock is mounted on the locking structure for preventing the IEEE1394 connectors from being stolen.

The aforementioned aspects and advantages of the present invention will be readily clarified in the description of the preferred embodiments and the enclosed drawings of the present invention.

DETAILED DESCRIPTION OF THE PREFERRED EMBODIMENT

Figure 1:
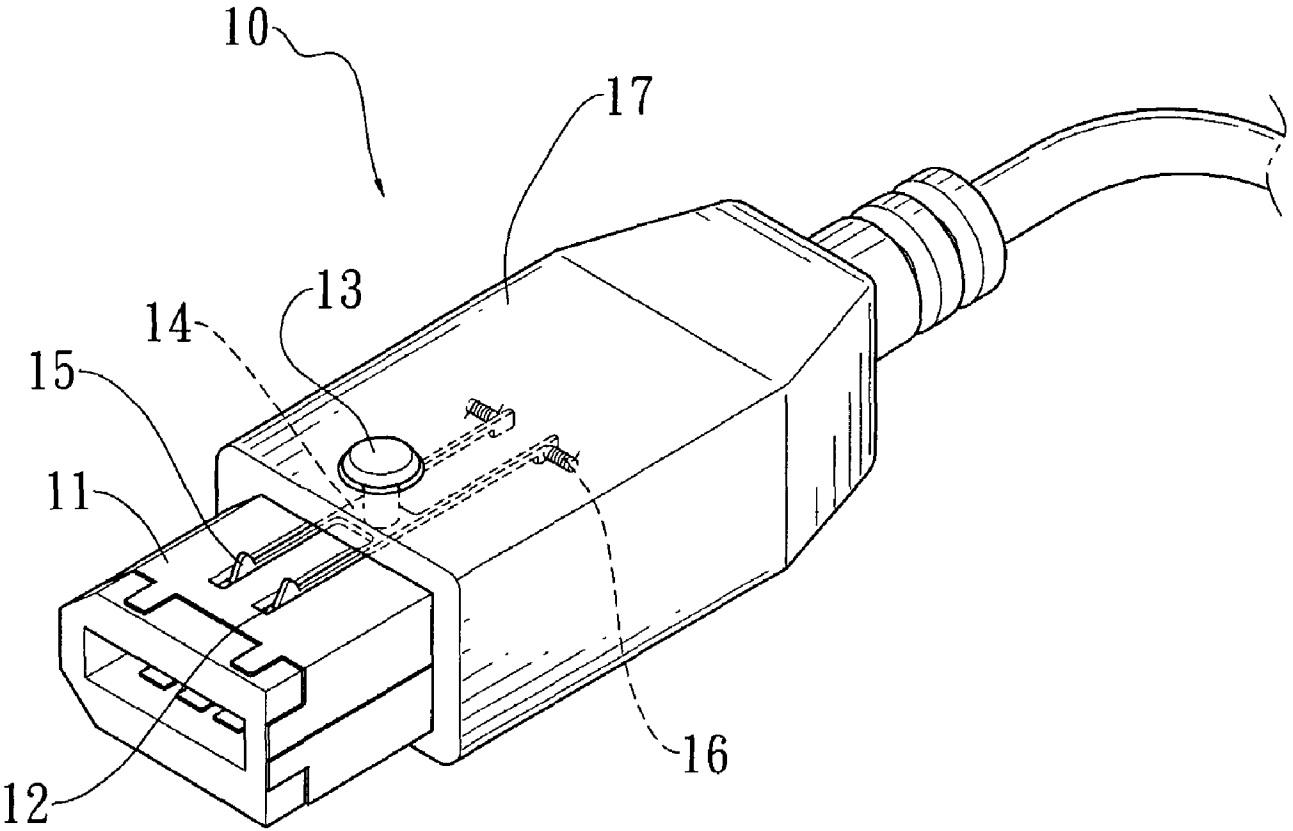
FIG. 1 is an elevational view showing a first preferred embodiment of the present invention.

The present invention is related to an IEEE1394 connector on which a locking structure is mounted, wherein the IEEE1394 connector is a male plug or a female socket. For the purpose of explanation, a male plug with six pins is illustrated in this preferred embodiment. As shown in FIG. 1, the male connector 10 comprises an outer frame 11 at the front end and a plastic housing 17 at the back end. An opening is formed on the outer frame 11, and a terminal is mounted on the upper and lower lateral surfaces of the opening. Besides, two trenches 12 are formed on the top surface or the bottom surface of the outer frame 11. A hole is formed on a surface of the plastic housing 17 corresponding to the surface of the outer frame 11 on which the trenches 12 are formed for insertion of a button 13. A sheet 14 is coupled to the bottom of the button 13 in a position and a shape corresponding to that of the trenches 12. A hooking part 15 is mounted at both front ends of the sheet 14, wherein each of the hooking parts 15 is designed to be a single hook or a double hook. A pair of pivots is mounted on both sides of the sheet 14, and a pair of limit springs 16 is penetrated by the pivots. Therefore, the sheet 14 is held up by the limit springs 16 so as to lean against the bottom edge of the plastic housing 17. If the button 13 is pressed, the hooking parts 15 are sunken into the trenches 12, correspondingly.

Figure 2:
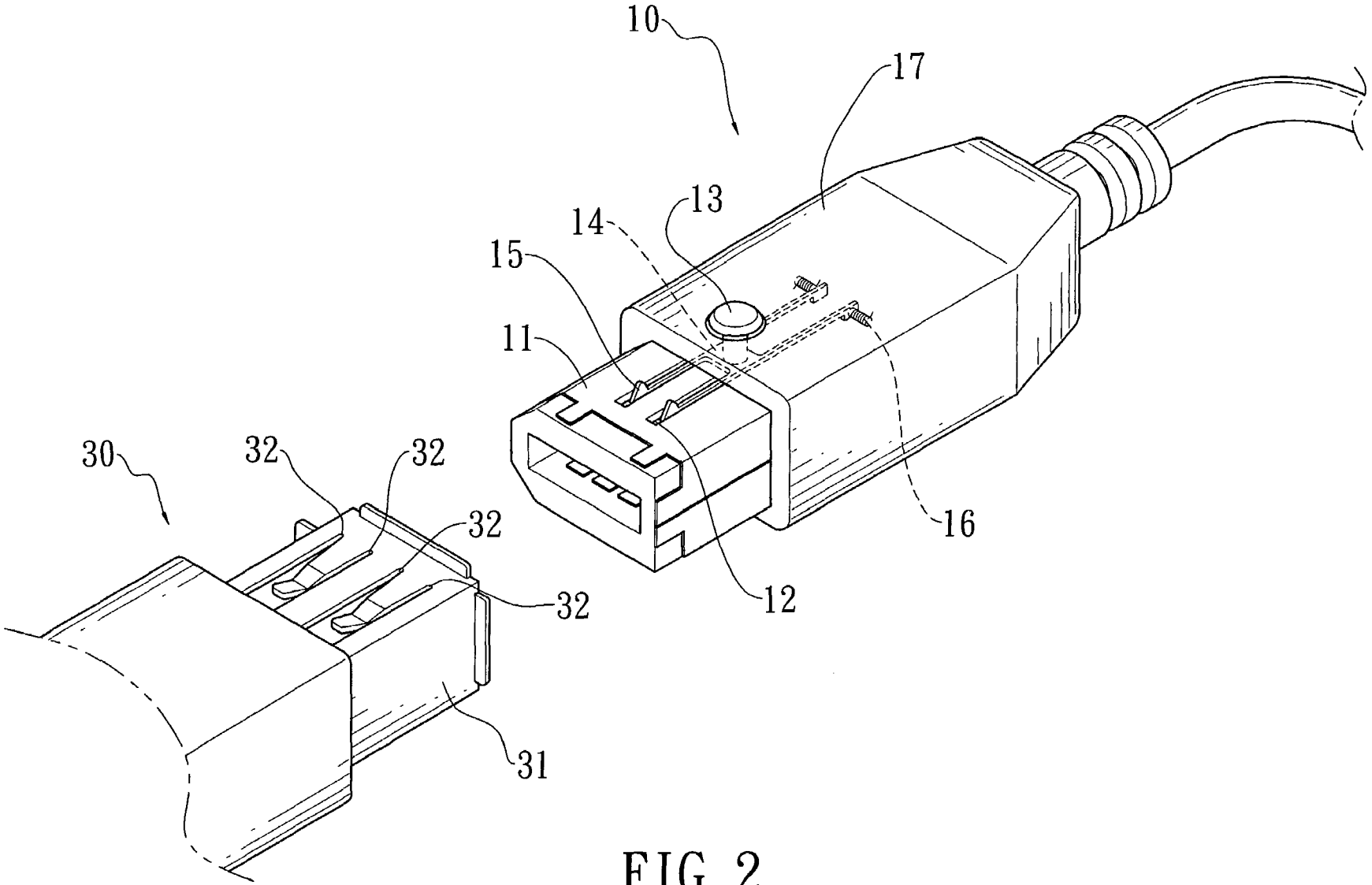
FIG. 2 is a schematic view showing the action for connecting the male connector and the female connector in accordance with first preferred embodiment of the present invention.
Figure 3:
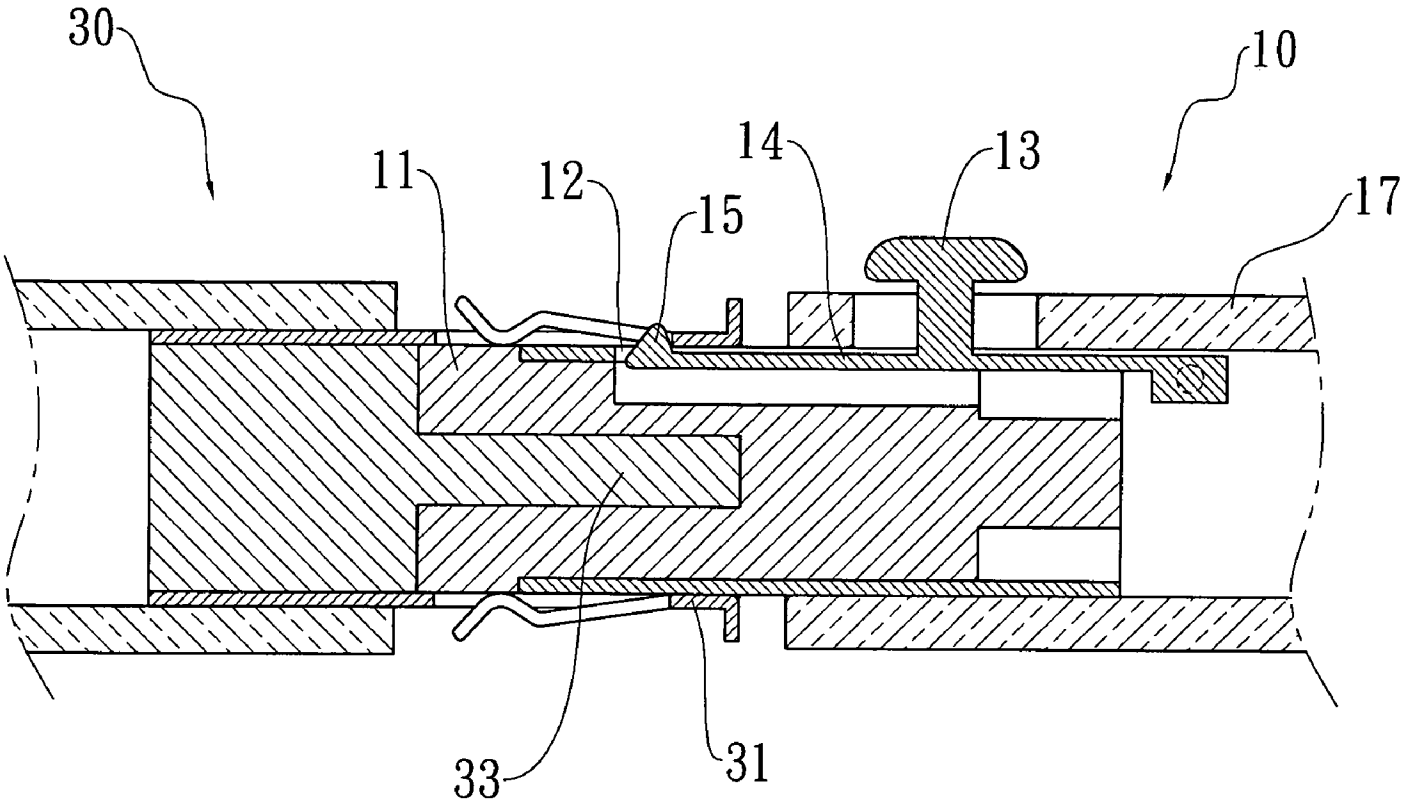
FIG. 3 is a schematic view showing that the male and female connectors are connected in accordance with first preferred embodiment of the present invention.

Referring to FIG. 2 and FIG. 3, for the purpose of inserting the male connector 10 into the female connector 30, the female connector 30 is provided with an outer frame 31, wherein two inwardly pressable elastic sheets are mounted on the upper and lower sides of the outer frame 31, respectively. Two openings 32 are formed on both sides of each elastic sheet. Besides, a terminal 33 is mounted on the center of the outer frame 31. When the male connector 10 couples with the female connector 30, the outer frame 11 of the male connector 10 covers the terminal 33 of the female connector 30, and the outer frame 31 of the female connector 30 covers the outer frame 11 of the male connector 10. By contacting the terminals of the male and female connectors with one another, the purpose of signal transmission is achieved.

Moreover, if the connectors 10, 30 are connected with one another, the hooking parts 15 mounted at the front ends of the sheet 14 of the male connector 10 are inserted into the openings 32 of the outer frame 31 of the female connector 30. Because of the steady locking between the hooking parts 15 and the openings 32, the connectors 10, 30 are prevented from being separated if they are pulled or tugged by external force. Nevertheless, the hooking parts 15 are separable from the openings 32 to separate the connectors 10, 30 by pressing down the button 13.

Figure 4:
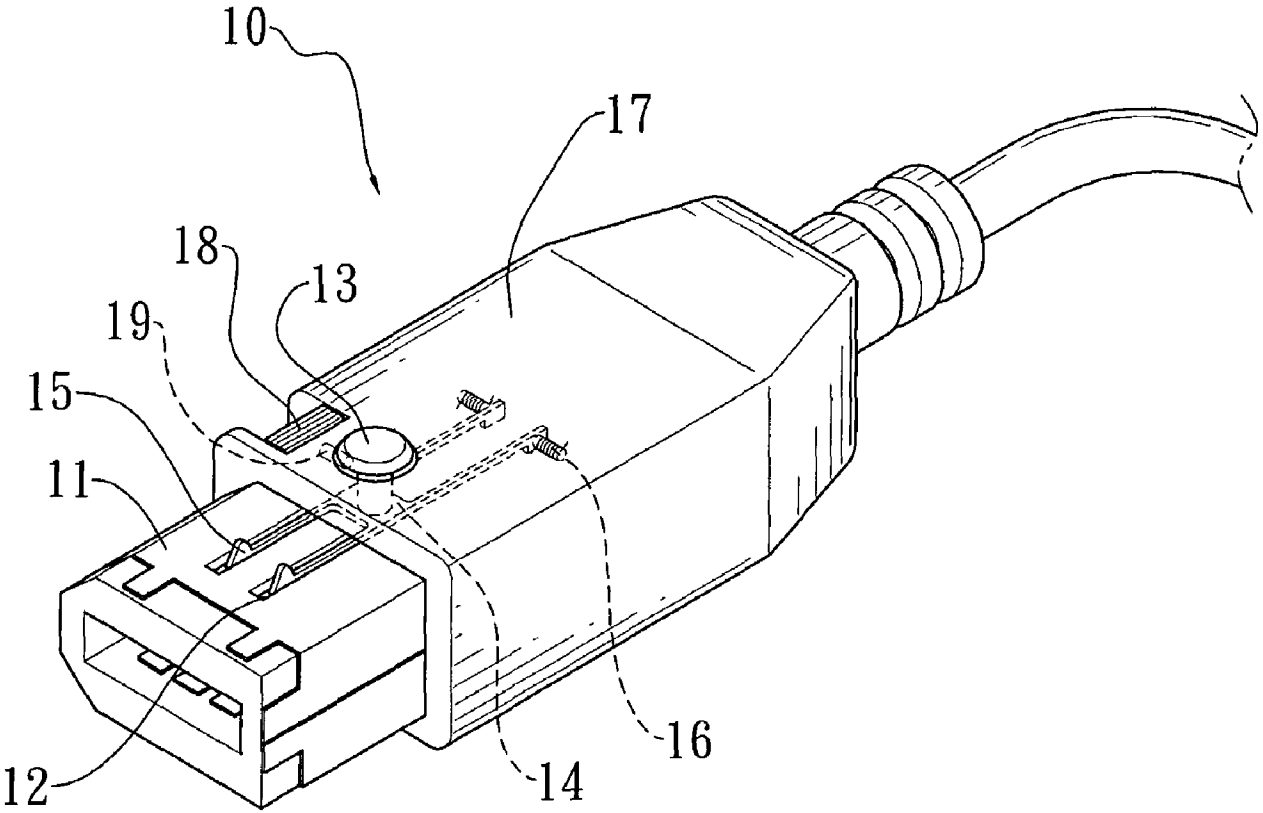
FIG. 4 is an elevational view showing a second preferred embodiment of the present invention.

Referring to FIG. 4, the male connector 10 further comprises a push button 18 mounted near the button 13. A pillar 19 is mounted on the bottom of the push button 18, and they are shiftable together. The pillar 19 is mounted lower than or equal to the bottom of the button 13 in height. By pushing the push button 18, the pillar 19 is shifted away from or toward the bottom of the button 13 so as to decide whether the button 13 can be pressed down. Consequently, the connector with the built-in lock is completed for providing the function of simply locking.

Figure 5:
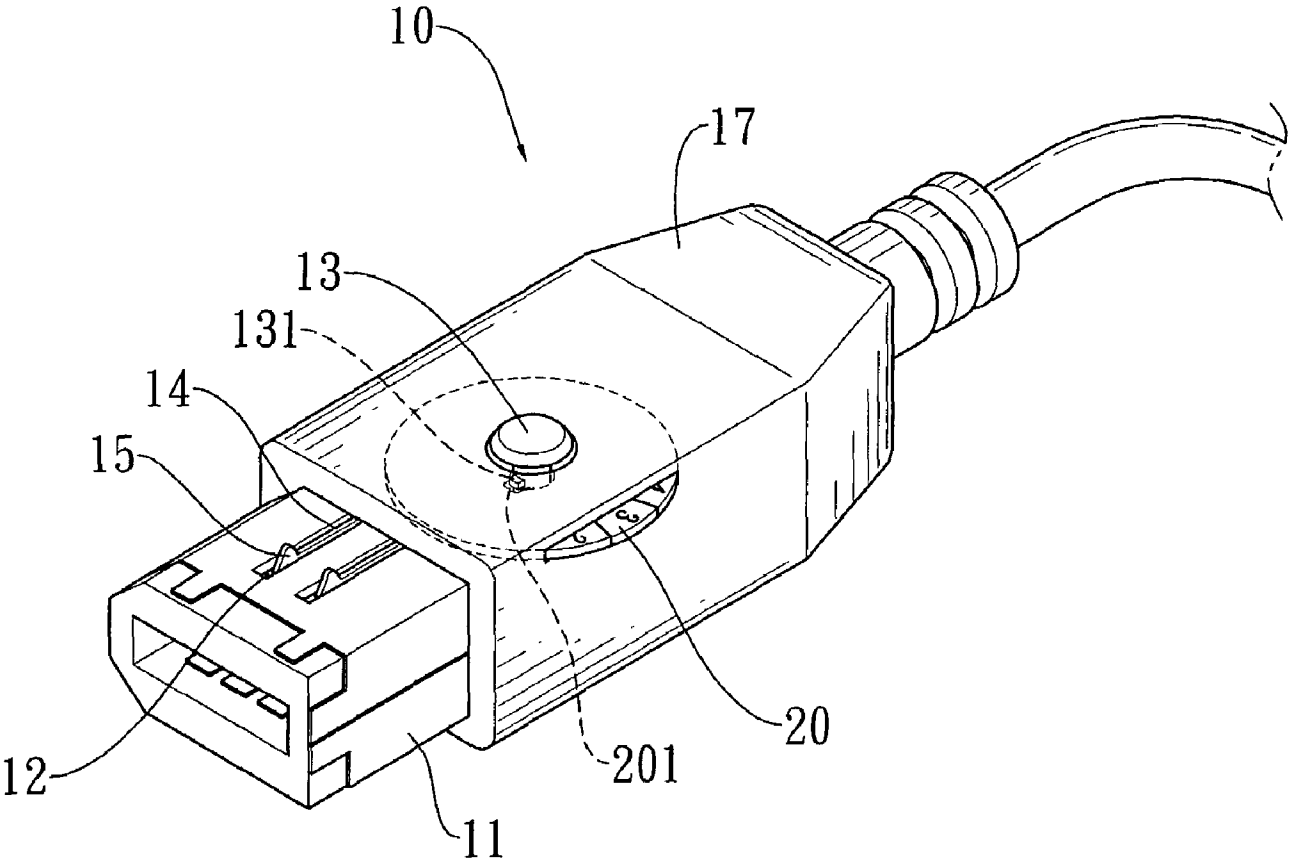
FIG. 5 is an elevational view showing a third preferred embodiment of the present invention.

Referring to FIG. 5, a protrudent block 131 is mounted on the body of the button 13. The body of the button 13 is inserted into a through hole of a plate 20, and a notch 201, which is in a shape equal to that of the protrudent block 131, is formed on the plate 20 adjacent to the through hole. Besides, the periphery of the plate 20 is divided into ten equalized sections on which ten numbers (0 to 9) are marked, respectively. Besides, the notch 201 is formed on one of these ten sections. It is assumed that the button 13 can be pressed down when the number three is obtained by rotating the plate 20 so as to enable the notch 201 to face the protrudent block 131. If the male connector 10 is inserted into the female connector 30, the hooking parts 15 at the front ends of the sheet 14 are designed to lock the corresponding openings 32 of the female connector 30. Next, the section number three is turned away from its former position by rotating the plate 20 randomly. As a result, the notch 201 is also turned away from the protrudent block 131 to prevent the button 13 from being pressed down. Accordingly, the present invention can prevent the theft when the user leaves the seat.

Figure 6:
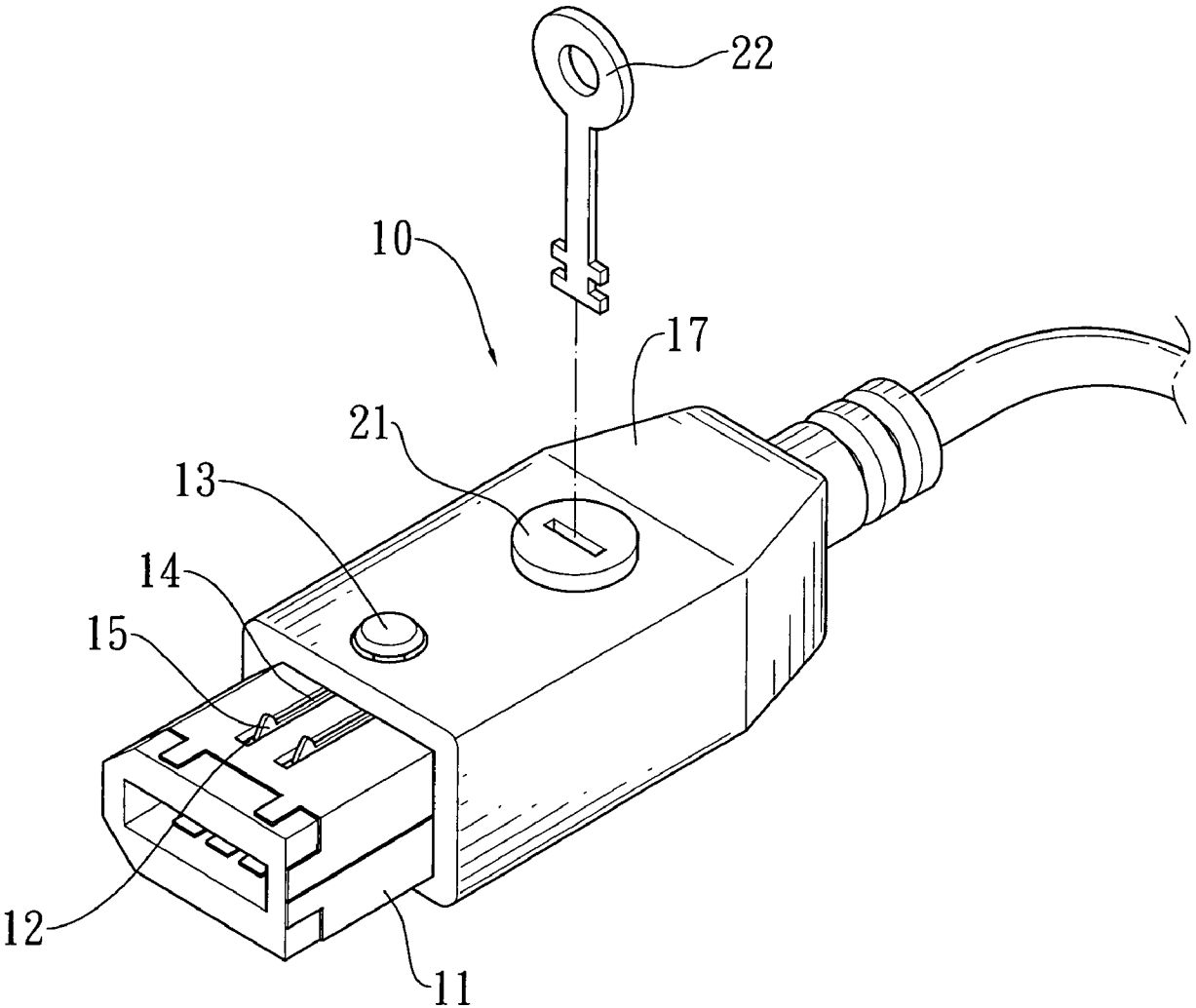
FIG. 6 is an elevational view showing a fourth preferred embodiment of the present invention.
Figure 7:
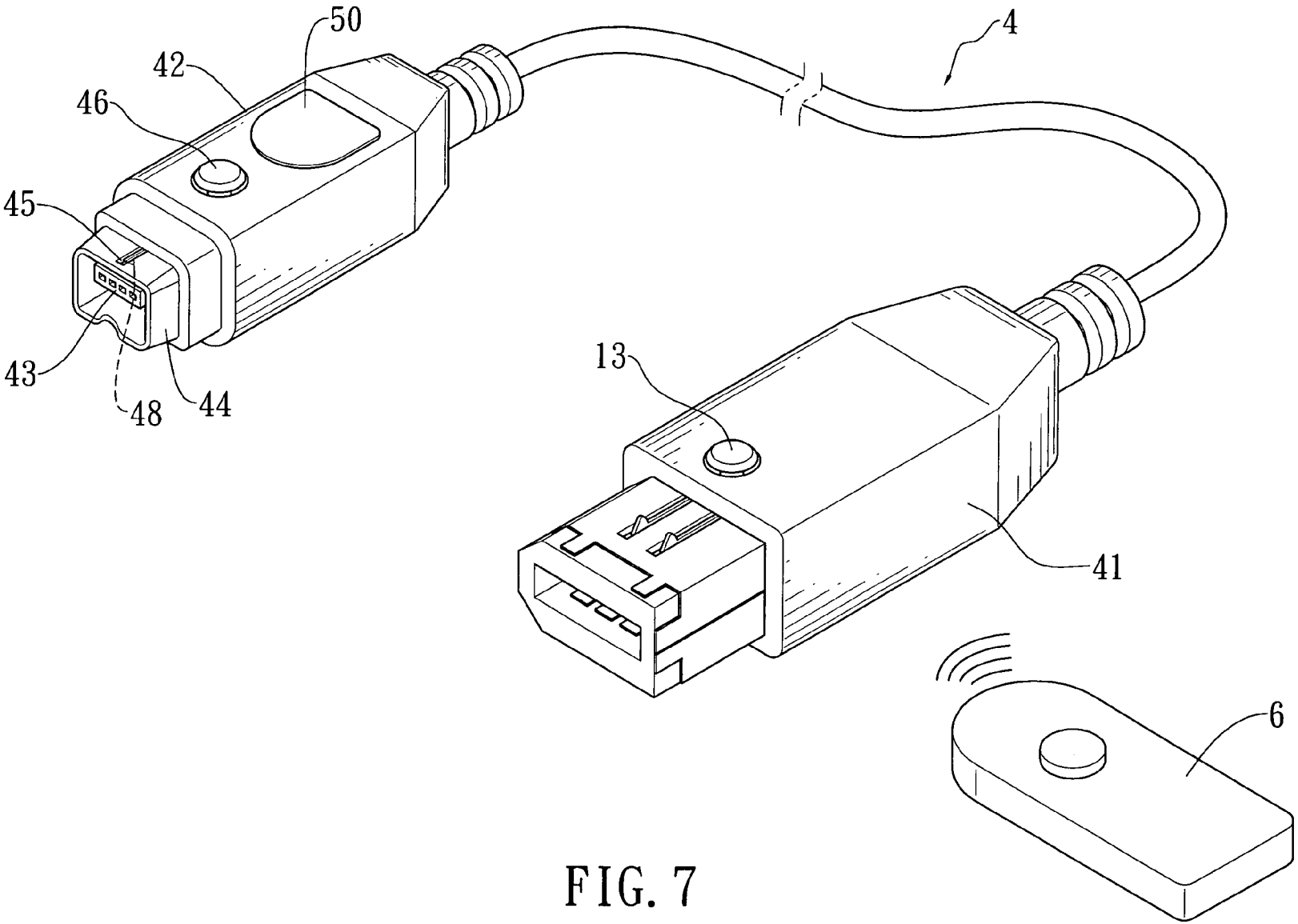
FIG. 7 is an elevational view showing a fifth preferred embodiment of the present invention.
Figure 8:
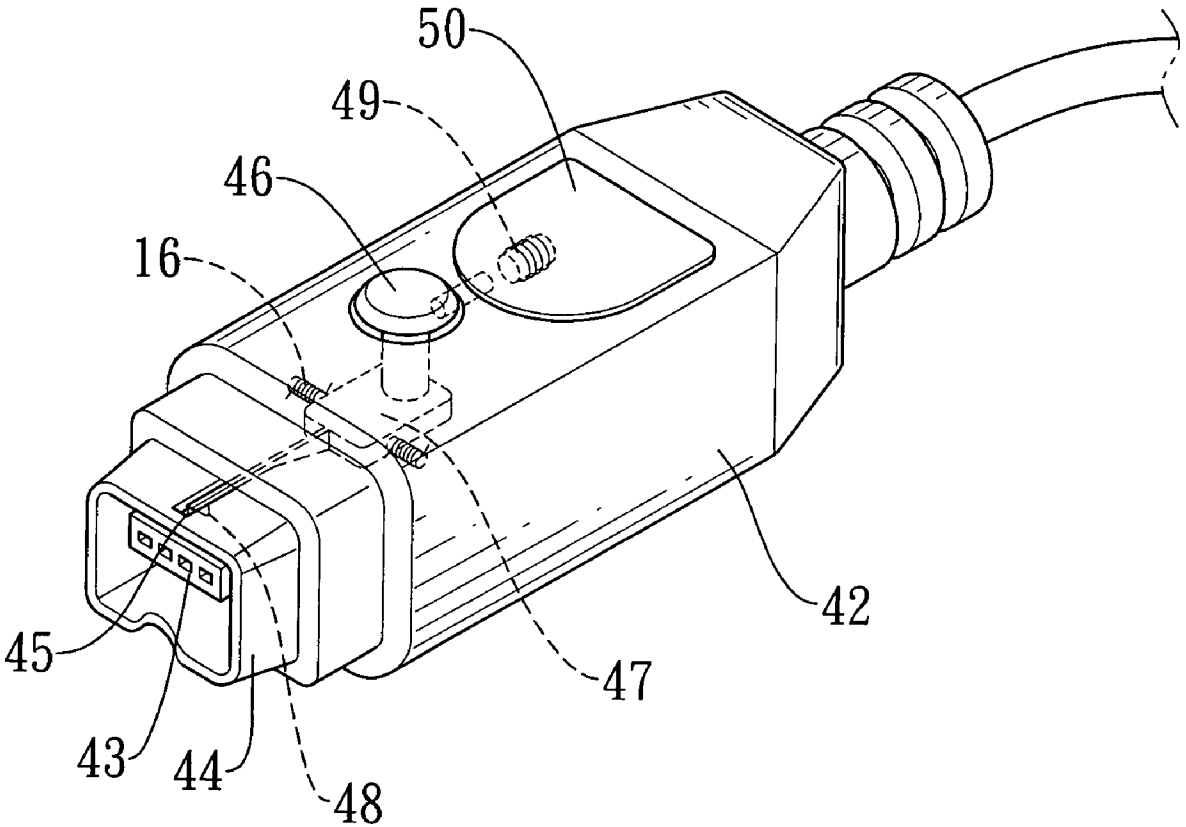
FIG. 8 is a partial perspective view showing the female connector of FIG. 7.

The button 13 can be controlled by various ways to be pressable or unpressable. For example, as shown in FIG. 6, a mechanical structure using a lock 21 and a key 22 can be used. Alternatively, as shown in FIG. 7, an electronic structure can be used, wherein a reed switch (not shown), which is moved together with a pillar, is mounted inside a male connector 41, which is connected to a connection wire 4. Besides, the reed switch is controlled by a remote control 6. After the remote control 6 is switched on, the pillar is moved backward by the reed switch to allow the button 13 to be pressed down. Furthermore, it is obvious that the locking structure of the present invention can be mounted on the female connector 42. Referring further to FIG. 8, a terminal 43, an insulating frame 44, and a plastic outer frame are mounted on the female connector 42. A through hole is formed on the plastic outer frame for mounting a button 46. A sheet 47 is connected to the bottom of the button 46. A downwardly extended hooking part 48 is mounted at a front end of the sheet 47. A pair of fixing shafts is outwardly protrudent from both middle laterals of the sheet 47, wherein a pair of limit springs 16 is penetrated by the fixing shafts. Besides, a trench is formed on the insulating frame 44 in a position corresponding to the sheet 47. As a result, when the button 46 is pressed down, the hooking parts 48 mounted at the front ends of the sheet 47 can be raised upwardly. A pillar, which is controlled by a reed switch 49, is mounted near the bottom of the button 46, wherein the reed switch 49 is further controlled by a fingerprint identifier 50.

As a result, the locking structures can be respectively mounted on the male connector 41 and the female connector 42, which are respectively connected to both ends of the connection wire 4. Consequently, the unauthorized person cannot separate the connected products, for example, the portable disk and the computer, which are connected to one another through the connection wire 4.

On the basis of the aforementioned description, it is apparent that the protection structure for use in the IEEE1394 connector can achieve the expected purposes for enhancing connection stability so as to avoid disconnection caused by pulling and prevent it from being stolen. The present invention satisfies all requirements for a patent and is submitted for a patent.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

The invention claimed is:

1. A protection structure for use in a first IEEE1394 connector, comprising:

a locking structure mounted on the first IEEE1394 connector, the locking structure being capable of hooking an opening formed on a second IEEE1394 connector that cooperates with the first IEEE1394 connector for enhancing the connection stability between the first and second connectors, wherein the first IEEE1394 connector is a male IEEE1394 connector on which a through hole and a trench is formed for mounting the locking structure, and the locking structure comprises:

a button; a sheet connected to the bottom of the button; an upwardly extended hooking part mounted at a front end of the sheet; a pair of pivots mounted on both rear sides of the sheet; and a pair of springs penetrated by the pivots, the protection structure further comprising a lock mounted on the locking structure to decide whether the button is pressable or unpressable.

2. The protection structure of claim 1, wherein the hooking part is designed to be a single hook or a double hook.

3. The protection structure of claim 1, wherein the lock is a mechanical key lock, a built-in lock, or a combination lock.

4. The protection structure of claim 1, wherein the lock is an electronic reed lock.

5. The protection structure of claim 4, wherein the electronic reed lock is controlled by a remote control or a fingerprint identifier.

6. A protection structure for use in a first IEEE1394 connector, comprising:

a locking structure mounted on the first IEEE1394 connector, the locking structure being capable of hooking an opening formed on a second IEEE1394 connector that cooperates with the first IEEE1394 connector for enhancing the connection stability between the first and second connectors, wherein the first IEEE1394 connector is a female IEEE1394 connector on which a through hole and a trench is formed for mounting the locking structure, and the locking structure comprises:

a button; a sheet connected to the bottom of the button; an upwardly extended hooking part mounted at a front end of the sheet; a pair of pivots mounted on both rear sides of the sheet; and a pair of springs penetrated by the pivots, the protection structure further comprising a lock mounted on the locking structure to decide whether the button is pressable or unpressable.

7. The protection structure of claim 6, wherein the hooking part is designed to be a single hook or a double hook.

8. The protection structure of claim 6, wherein the lock is a mechanical key lock, a built-in lock, or a combination lock.

9. The protection structure of claim 6, wherein the lock is an electronic reed lock.

10. The protection structure of claim 9, wherein the electronic reed lock is controlled by a remote control or a fingerprint identifier.

* * * * *